US006152559A

United States Patent [19]

Kojima

[11] Patent Number: 6,152,559

[45] **Date of Patent: *Nov. 28, 2000**

[54] INK-JET PRINTING DEVICE HAVING PURGING ARRANGEMENT

[75] Inventor: Masatomo Kojima, Ichinomiya, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/976,042

[22] Filed: Nov. 21, 1997

[30] Foreign Application Priority Data

Nov. 21, 1996 [JP] Japan ..... 8-310763

[51] Int. Cl.[7] ..... B41J 2/18

[52] U.S. Cl. ..... 347/89

[58] Field of Search ..... 347/85, 86, 87, 347/89, 93

[56] References Cited

U.S. PATENT DOCUMENTS 4,121,222 10/1978 Diebold et al. ..... 347/7
4,380,770 4/1983 Maruyama ..... 347/29
4,558,326 12/1985 Kimura et al. ..... 347/30
5,818,485 10/1998 Rezanka ..... 347/89

*Primary Examiner*—N. Le
*Assistant Examiner*—Michael Nghiem
*Attorney, Agent, or Firm*—Oliff & Berridge, PLC

[57] ABSTRACT

An ink supply device is fluidly connected to a ink-jet head by first and second ink channels. The first ink channel connects an ink tank of the ink supply device to an inlet of a manifold of a ink-jet head, and the second ink channel connects an outlet of the manifold to the ink tank. In the ink-jet head, a plurality of pressure chambers each communicating with the manifold and a plurality of nozzles each connected to each pressure chamber are formed. During purging, ink is expelled by increasing pressure in the ink tank so that the ink flows through the manifold, pressure chambers, and nozzles, in that order. At the same time, ink flows through the first ink channel, the manifold, and the second ink channel to be collected in the ink tank. During the purging, the amount of ink expelled and the amount of ink collected can be maintained at appropriate values since the flow resistance In the plurality of parallel ink channels connecting the pressure chambers and nozzles is set from about 1 to 5 times the flow resistance of the second ink channel.

11 Claims, 2 Drawing Sheets

INK-JET PRINTING DEVICE HAVING PURGING ARRANGEMENT

BACKGROUND OF THE INVENTION

The present invention relates to an ink-jet printing device having a ink-jet head purging arrangement.

Control of ink drops in an ink-jet printing device is essential in order to produce high quality printed documents. In order to always eject ink drops of a consistent amount at the proper speed and in the proper direction, it is necessary to create an appropriate environment for ink within the nozzles and ink chambers. Air bubbles entering the manifold or pressure chambers from the nozzles or ink tanks, air bubbles generated in the air chambers, and solid matter created from drying and the like are the main factors that prevent desirable quality in printing.

Conventionally, air bubbles and solid matter that are generated or that enter the printing head and ink supply device of an ink-jet printing device have been removed by a purging method which applies a desired pressure to the ink tank supplying the ink to forcefully expel the air bubbles and solid matter through the nozzles.

However, since a large amount of ink is expelled from the nozzles during purging, not only can the recording paper and surrounding area of the nozzles become stained with ink, but the expelled ink cannot be reused, making the process uneconomical.

SUMMARY OF THE INVENTION

In view of the problems described above, it is an object of the present invention to provide an ink-jet printing device capable of minimizing the amount of ink that is expelled when purging the ink head and ink supply device, while reliably eliminating the air bubbles and solid matter, thereby guaranteeing lasting and stable printing quality.

This and other objects of the present invention will be attained by an ink-jet printing device including an ink-jet head, first and second ink channels, an ink tank, and a pressure applying device. The ink-jet head has a plurality of parallel pressure chambers each having one end and another end and arrayed side by side in an array direction. The head also forms nozzles connected to the one end of the pressure chambers and a manifold connected to the other end of the pressure chambers. The plurality of pressure chambers and nozzles provide a first flow resistance to ink flow. The manifold extends in the array direction and has an inlet end positioned adjacent a first pressure chamber and an outlet end positioned adjacent a last pressure chamber. The first ink channel has one end connected to the inlet end of the manifold. The first ink channel has another end. The second ink channel has one end connected to the outlet end of the manifold and has another end. The second ink channel provides a second flow resistance to ink flow. The first flow resistance is 1 to 5 times the second flow resistance. The ink tank accumulates therein an ink. The another end of the first ink channel and the another end of the second ink channel are connected to the ink tank for supplying the ink from the ink tank to the ink-jet head through the first ink channel and for circulating the ink in the ink-jet head to the ink tank through the second ink channel. The pressure applying device is adapted for applying pressure to ink accumulated in the ink tank for supplying the ink in the ink tank toward the first ink channel.

DETAILED DESCRIPTION OF THE PREFERRED EMBODIMENT

An ink-jet printing device according to a preferred embodiment of the present invention will be described while referring to the accompanying drawings.

Figure 2:
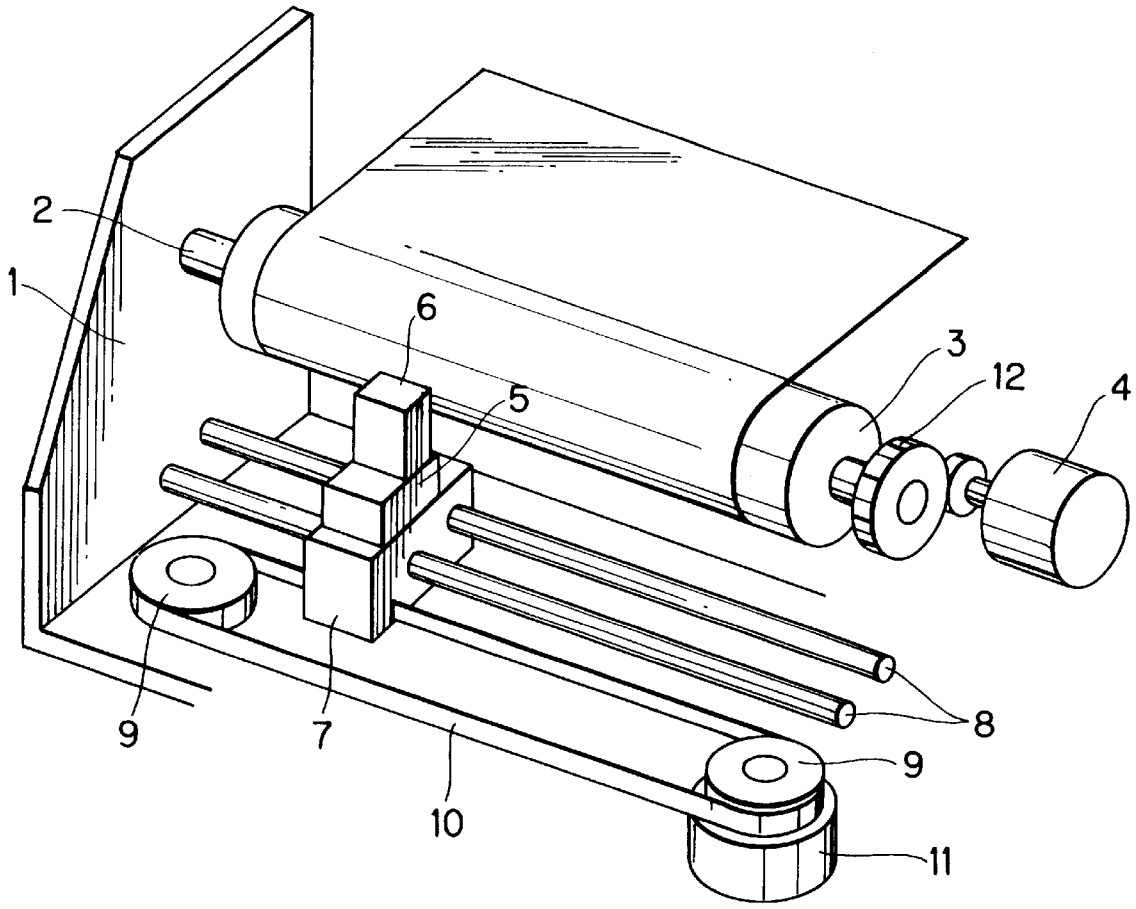
FIG. 2 is a perspective view showing a printing mechanism of the ink-jet printing device according to the embodiment.

As shown in FIG. 2, the ink-jet printing device includes a pair of side frames 1, a shaft 2 rotatably supported between the pair of side frames 1, a platen 3 coaxially mounted over the shaft 2, and a motor 4 for rotationally driving the platen 3 by way of a gear transmissions 12. The device further includes a pair of guide rods 8 extending between the side frames 1 and in parallel to the platen 3, a carriage 7 supported on the two guide rods 8 and slidingly movable therealong, an ink supply device 5 and an ink-jet head 6 mounted on the carriage 7 and in confrontation with the platen 3. The ink-jet printing device is further provided with a pair of pulleys 9, a timing belt 10 looped around the pulleys 9 and engaged with the carriage 7, and a motor 11 for driving one of the pulleys 9 (the right pulley in FIG. 2). This pulley 9 is coaxially coupled on a drive shaft of the motor 11 and is driven in a rotating direction by the motor 11, causing the timing belt 10 to convey the carriage 7 back and forth along the platen 3.

Figure 1:
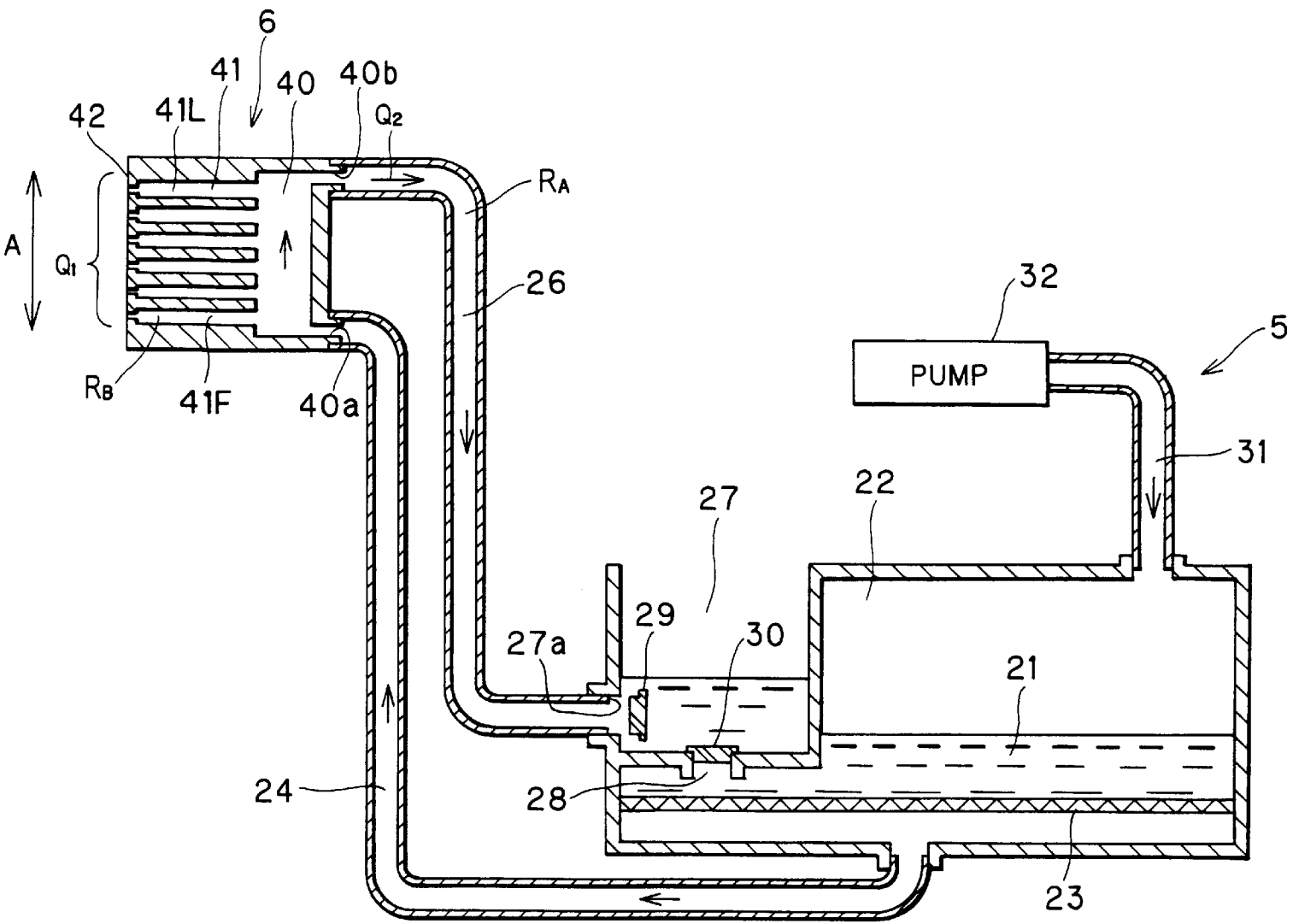
FIG. 1 is a cross-sectional view showing relevant parts of an ink supply system and an ink jet head of an ink-jet printing device according to one embodiment of the present invention.

Next, an internal construction of the ink-jet head 6 and ink supply device 5 will be described with reference to FIG. 1.

The ink-jet head 6 has a manifold 40, a plurality of pressure chambers 41 and a plurality of nozzles 42. An actuator (not shown) is provided in each of the pressure chambers 41. Each rear end of the pressure chamber 41 is in fluid communication with the manifold 40, and each front end of the pressure chamber 41 is connected to the nozzle 42 through which ink is ejected. The plurality of pressure chambers 41 are arrayed side by side in an array direction A shown in FIG. 2. The manifold 40 extends in the array direction A. The manifold has an inlet end 40*a* positioned adjacent a first pressure chamber 41F and an outlet end 40*b* positioned adjacent a last pressure chamber 41L.

The ink supply device 5 includes an ink tank having a main tank 22 containing therein an ink 21. A filter 23 is provided in the lower portion of the main tank 22. Further, the ink tank includes a sub tank 27 provided adjacent the main tank 22 and at the position above the filter 23. A first ink channel 24 is connected between a bottom portion of the main tank 22 and the ink inlet 40*a* of the manifold 40 for supplying ink 21 in the main tank 22 into the ink jet head 6. A second ink channel 26 is connected between the ink outlet 40*b* and the sub tank 27 for circulating the ink in the ink jet head 6 into the sub tank 27. A hole 27*a* is formed in the sub tank 27 for connecting one end of the second ink channel 26 to the sub tank 27, and a first cap 29 is provided for selectively capping the hole 27*a*. Further, a hole 28 is formed at a bottom wall of the sub tank 27 for providing fluid communication between the sub tank 27 and the main tank 21, and a second cap 30 is provided for selectively capping the hole 28. An air pressure pump or pneumatic pump 32 is connected to the main tank 22 via a pressure tube 31 for compressing the internal space of the main tank 22.

During the printing process, the first cap 29 is closed and the second cap 30 is open. Ink drops are ejected from the nozzles 42 when the actuators (not shown) within the pressure chambers 41 are driven according to a printing pattern. At this time, ink that has passed from the main tank 22 through the filter 23 is supplied to the manifold 40 via the first ink channel 24. During the printing operation, ink 21 can be prevented from flowing in the reverse direction from the sub tank 27 through the second ink channel 26 by closing the first cap 29. Further, by opening the cap 30, the ink circulated into the sub tank 27 can flow into the main tank 22 through the hole 28. Since the filter 23 is positioned below the sub-tank 27, unwanted foreign particles or solidified ink can be trapped at the filter 21.

During purging operation for removing air bubbles and solid matter that have been generated or have entered the ink-jet head 6 and ink supply device 5, the first cap 29 is opened and the second cap 30 is closed. Air pressure from the air pressure pump 32 is introduced into the main tank 22. Since the main tank 22 is hermetically sealed by the closure of the second cap 30, pressure within the main tank 22 increases, forcing ink from the main tank 22 to flow via the filter 23 and first ink channel 24 to the manifold 40. In the manifold 40, a portion of the ink is expelled from the nozzles 42 via the pressure chambers 41, while the remaining portion of ink is forced to flow into the sub tank 27 via the second ink channel 26.

During purging operation, if too little ink is expelled from the nozzles 42, the air bubbles in the pressure chambers 41 will not be sufficiently removed. Further, if the overall amount of ink flow is insufficient, the air bubbles within the first ink channel 24 and second ink channel 26 will not be sufficiently removed. Hence, it is necessary to maintain an appropriate balance in the amount of ink being expelled and the amount of ink being recovered during the purging operation.

In order to investigate the optimum balance, attention is drawn to a resistance $R_A$ against ink flow flowing through the second ink channel 26 and a resistance $R_B$ against ink flow flowing thorough one pressure chamber 41 and an associated nozzle 42.

The relationship of the flow resistance to the shape of the pressure chambers 41, nozzles 42, and second ink channel 26 will be described. First, a pressure loss P resulting when a fluid flows through a cylindrical channel can be described with the following equation (1).

$$P = \frac{8\mu LQ}{\pi r^2} \tag{1}$$

Here, P is pressure loss in kgf/cm$^2$, r is the channel radius in cm, L is the channel length in cm, $\mu$ is the viscosity of the fluid in kgfs/cm$^2$, and Q is the quantity of flow in cc/s. At this time, the flow resistance R can be represented by the ratio of the pressure loss P to the quantity of flow Q.

R=P/Q

In this connection, when the second ink channel 26 is cylindrically shaped with a radius $r_1$ and a length $L_1$, the flow resistance $R_A$ to the ink can be represented by the following equation (2).

$$R_A = \frac{8\mu L_1}{\pi r_1^4} \tag{2}$$

Further, when the pressure chambers 41 are cylindrically shaped with radii $r_2$ and lengths $L_2$, and when the nozzles 42 are cylindrically shaped with radii $r_3$ and lengths $L_3$, the flow resistance $R_B$ for each pressure chamber 41 and associated nozzle 42 can be described with the following equation (3).

$$R_B = \frac{8\mu}{\pi}\left(\frac{L_2}{r_2^4} + \frac{L_3}{r_3^4}\right) \tag{3}$$

A total flow resistance of the ink head 6 can be represented by $R_B/N$, wherein N is the number of pressure chambers 41 connecting to the manifold 40. Further, it is assumed that $Q_1$ is the quantity of ink expelled from the nozzles 42 during purging operation, and $Q_2$ is the quantity of ink recovered into the sub tank 27 during the purging operation.

If the flow resistance $R_A$ is high, ink is difficult to flow through the second ink channel 26, and therefore, large amount of ink $Q_1$ is expelled from the nozzles 42. On the other hand, if flow resistance $R_A$ is low, ink is easily flowed through the second ink channel 26, and therefore, large amount of ink $Q_2$ can be recovered into the sub tank 27. That is $R_A$ is proportional to $Q_1$ and disproportional to $Q_2$.

Further, if the flow resistance $R_B/N$ is high, ink is difficult to flow through the nozzles 42, and therefore, large amount of ink $Q_2$ is circulated into the sub tank 27. On the other hand, if flow resistance $R_B/N$ is low, ink can be easily ejected through the nozzles 42, and therefore, large amount of ink $Q_1$ is expelled from the nozzles 42. That is, $R_B/N$ is proportional to $Q_2$ and disproportional to $Q_1$.

Accordingly, the following relationship between $Q_1$ and $Q_2$ can be provided:

$$Q_1:Q_2=R_A:R_B/N$$

By establishing an appropriate ratio of resistance in the second ink channel 26 to resistance in the plurality of parallel channels connecting the pressure chambers 41 and nozzles 42, it is possible to adjust the amounts of ink being expelled and ink being recovered during the purging operation.

In the present embodiment, the resistance in the plurality of parallel channels connecting the pressure chambers 41 and nozzles 42 is set to between about 1 and 5 times the resistance in the second ink channel 26, so that the following equation is satisfied.

$$1 \leqq R_B/(R_A \cdot N) \leqq 5$$

If this ratio is less than 1, the amount of ink expelled from the nozzles 42 will increase, which is wasteful. Further, air in the second ink channel 26 cannot be adequately purged or discharged. On the other hand, if this ratio is greater than 5, the air in the pressure chambers 41 cannot be adequately discharged therefrom.

Experiments were conducted to investigate proper or optimum ratio ($Q_2/Q_1$). Two kind of ink-jet heads 6 providing flow resistance $R_B$ different from each other were prepared. Each ink-jet head had 128 channels. Further, three kinds of second ink channels 26 providing flow resistance $R_A$ different from one another were prepared. Stability of ink ejection from the nozzles was checked by changing combination of the kind of the ink-jet head 6 and the second ink channel 26.

In case of the insufficient purging, several channels among 128 channels exhibited insufficient ink discharge after performing several times printing in which ink were ejected through all nozzles. With this understanding, insufficient channel numbers among 128 channels were counted after 10 times printing in order to evaluate stability of the channels. The test result is shown in Table 1.

TABLE 1

| Flow resistance (kgf · s/cm$^5$) | | Quantity of flow (cc/s) | | ratio | Number of unsteady |
|---|---|---|---|---|---|
| $R_A$ | $R_B$ | $Q_2$ | $Q_1$ | $Q_2/Q_1$ | channels |
| 0.702 | 97.4 | 0.073 | 0.0683 | 1.1 | 1~5 |
| 0.702 | 116.7 | 0.075 | 0.0583 | 1.3 | 0~3 |
| 0.267 | 97.4 | 0.157 | 0.0564 | 2.8 | 0~3 |
| 0.267 | 116.7 | 0.159 | 0.0479 | 3.3 | 0~5 |
| 0.113 | 97.4 | 0.262 | 0.0413 | 6.3 | 5~9 |
| 0.113 | 116.7 | 0.266 | 0.0349 | 7.6 | 3~12 |

As is apparent from the test result, $Q_2/Q_1$ is preferably in a range of from 1.1 to 3.3, and more preferably, from 1.3 to 3.3. It should be noted that $Q_2/Q_1$ is equivalent to $R_B/(R_A \cdot N)$.

According to the ink-jet printing device of the illustrated embodiment, during the purging operation, ink is expelled by increasing pressure in the main tank 22 so that the ink 21 flows through the manifold 40, the pressure chambers 41, and the nozzles 42, in that order. At the same time, ink flows through the first ink channel 24, the manifold 40, and the second ink channel 26 to be collected in the sub tank 27. During the purging, the amount of ink expelled and the amount of ink collected can be maintained at appropriate values since the resistance to ink in the plurality of parallel ink channels connecting the pressure chambers 41 and nozzles 42 is set from about 1 to 5 times the resistance of the second ink channel 26. Hence, the amount of ink that is expelled during the purging can be minimized, while reliably eliminating the air bubbles and solid matter. Further, by simply opening and closing the caps 29 and 30, it is possible to apply uniform pressure to the ink 21 in the main tank 22 by the actuation of the pneumatic pump 32 for purging. In other words, purging can be performed by a simple arrangement.

While the invention has been described in detail and with reference to the specific embodiments thereof, it would be apparent to those skilled in the art that various changes and modifications may be made therein without departing from the spirit and scope of the invention.

What is claimed is:

1. An ink-jet printing device, comprising:

an ink-jet head having a plurality of parallel pressure chambers each having one end and another end and arrayed side by side in an array direction, nozzles connected to the one end of the pressure chambers, and a manifold connected to the another end of the pressure chambers, wherein the plurality of pressure chambers and the nozzles have a structure providing a first flow resistance to ink flow, the manifold extending in the array direction and having an inlet end positioned adjacent a first pressure chamber of said plurality of pressure chambers and an outlet end positioned adjacent a last pressure chamber of said plurality of pressure chambers;

a first ink channel having one end connected to the inlet end of the manifold, the first ink channel having another end;

a second ink channel having one end connected to the outlet end of the manifold and having another end, the second ink channel has a structure providing a second flow resistance to ink flow, wherein the first flow resistance being 1 to 5 times the second flow resistance;

an ink tank accumulating therein an ink, the another end of the first ink channel and the another end of the second ink channel being connected to the ink tank for supplying the ink from the ink tank to the ink-jet head through the first ink channel and for circulating the ink in the ink-jet head to the ink tank through the second ink channel; and a pressure applying device connected to and applying pressure to ink accumulated in the ink tank for supplying the ink in the ink tank toward the first ink channel, so that a part of the ink supplied from the ink tank is ejected out of the nozzles and a remaining part of the ink being recirculated into the ink tank by the pressure in a single step purging operation without any capping of the nozzles.

2. An ink-jet printing device as claimed in claim 1, wherein the first flow resistance being 1.1 to 3.3 times the second flow resistance.

3. An ink-jet printing device as claimed in claim 2, wherein the first flow resistance being 1.3 to 3.3 times the second flow resistance.

4. An ink-jet printing device as claimed in claim 1, wherein the pressure applying device comprises a pneumatic pump for applying air pressure, and wherein the ink-jet printing device further comprising a first cap for selectively blocking the fluid connection between the ink tank and the second ink channel.

5. An ink-jet printing device as claimed in claim 4, wherein the ink tank comprises a main tank and a sub tank selectively communicatable with the main tank, the another end of the second ink channel being connected to the sub tank.

6. The ink-jet printing device as claimed in claim 5, wherein the pneumatic pump is communicated with the main tank, and the printing device further comprising a second cap for selectively blocking the fluid connection between the sub tank and the main tank.

7. The inkjet printing device as claimed in claim 6, wherein the sub tank has a bottom wall portion where the second cap is provided, so that the ink communication between the sub tank and the main tank is provided by opening the second cap and the communication is blocked by closing the second cap;

and wherein the first cap is provided at the another end of the second ink channel, so that the ink communication between the second ink channel and the sub tank is provided by opening the first cap and the communication is blocked by closing the first cap, and wherein an atmospheric pressure is applied to the ink in the sub tank.

8. The ink jet printing device as claimed in claim 7, further comprising a filter disposed in the main tank and at a position below the bottom wall portion of the sub tank, the another end of the first ink channel being connected to the main tank at a position below the filter.

9. The ink-jet printing device as claimed in claim 5, wherein the another end of the first ink channel is connected to the main tank.

10. The ink-jet printing device as claimed in claim 5, wherein the sub tank has a bottom wall portion at which the second cap is detachably provided, and the ink-jet printing device further comprising a filter disposed in the main tank and at a position below the bottom wall portion of the sub tank.

11. The ink-jet printing device as claimed in claim 1, wherein the flow resistance is calculated by the following equation: $R=P/Q$, $P=8\mu LQ/\pi r^4$,
in which R: flow resistance, P: pressure loss, Q: quantity of ink flow, $\mu$: viscosity of the ink, L: ink channel length, and r: ink channel radius.

* * * * *